US007540788B2

(12) United States Patent
Murphy et al.

(10) Patent No.: US 7,540,788 B2
(45) Date of Patent: Jun. 2, 2009

(54) BACKWARD COMPATIBLE CONNECTOR SYSTEM

(75) Inventors: R. Sean Murphy, Sunnyvale, CA (US); Wim Crooijmans, San Jose, CA (US); Richard Howarth, San Francisco, CA (US); Christopher Stringer, Portola Valley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 11/650,330

(22) Filed: Jan. 5, 2007

(65) Prior Publication Data

US 2008/0166905 A1 Jul. 10, 2008

(51) Int. Cl.
*H01R 24/00* (2006.01)

(52) U.S. Cl. ..... 439/676

(58) Field of Classification Search ..... 439/676, 439/941, 620

See application file for complete search history.

(56) References Cited

U.S. PATENT DOCUMENTS

| | | | | |
|---|---|---|---|---|
| 4,567,608 | A * | 1/1986 | Watson et al. | 381/122 |
| 4,850,899 | A | 7/1989 | Maynard | |
| 5,055,069 | A | 10/1991 | Townsend et al. | |
| 5,080,603 | A | 1/1992 | Mouissie | |
| 5,104,243 | A | 4/1992 | Harding | |
| 5,108,313 | A | 4/1992 | Adams | |
| 5,186,646 | A | 2/1993 | Pederson | |
| 5,235,217 | A * | 8/1993 | Kirton | 307/326 |
| 5,267,881 | A | 12/1993 | Matuzaki | |
| 5,277,624 | A | 1/1994 | Champion | |
| 5,344,335 | A | 9/1994 | Scholz et al. | |
| 5,425,650 | A | 6/1995 | Maeda | |
| 5,586,893 | A | 12/1996 | Mosquera | |

(Continued)

FOREIGN PATENT DOCUMENTS

CN 1282124 A 1/2001

(Continued)

OTHER PUBLICATIONS

Derman, Glenda; "Monitors Make Net Connections"; 1996, *Electronic Engineering Times*, vol. 933, pp. 60 and 69.

(Continued)

*Primary Examiner*—Jean F Duverne
(74) *Attorney, Agent, or Firm*—Townsend and Townsend and Crew LLP

(57) ABSTRACT

Various embodiments of connectors and connector assemblies provide modified structural features to meet evolving industrial design requirements while maintaining backward compatibility. In one embodiment, alignment posts on the two sides of a plug connector are substantially removed and the remaining connector shell reshaped so as to preserve alignment capability. Other pre-existing features such as alignment grooves and some or all springy raised tabs can be eliminated resulting in a more compact and monolithic structure for the connector without impacting functionality or backward compatibility. In another embodiment, a trim ring is molded to the base of the connector to form an integrated unit. The integrated unit results in a reduced size of the connector when it is incorporated into other devices such as a docking station. In yet another embodiment, a printed circuit board is integrated into the boot of a connector assembly to act as an intermediate connection mechanism between the cable wires and the connector pins. Other functionality such as identification circuitry or electrostatic discharge protection circuitry can be incorporated on to the integrated printed circuit board.

22 Claims, 7 Drawing Sheets

U.S. PATENT DOCUMENTS

| | | | | |
|---|---|---|---|---|
| 5,660,558 | A | 8/1997 | Osanai et al. | |
| 5,697,817 | A * | 12/1997 | Bouchan et al. | 439/676 |
| 5,830,001 | A | 11/1998 | Kinoshita | |
| 5,901,049 | A | 5/1999 | Schmidt et al. | |
| 5,975,957 | A | 11/1999 | Noda et al. | |
| 5,990,758 | A * | 11/1999 | Matsubara | 333/100 |
| 6,053,773 | A | 4/2000 | Wu | |
| 6,116,943 | A * | 9/2000 | Ferrill et al. | 439/418 |
| 6,154,798 | A | 11/2000 | Lin et al. | |
| 6,203,345 | B1 | 3/2001 | Roque et al. | |
| 6,206,480 | B1 | 3/2001 | Thompson | |
| 6,267,623 | B1 | 7/2001 | Hisamatsu | |
| 6,319,061 | B1 | 11/2001 | Chen et al. | |
| 6,322,396 | B1 | 11/2001 | Kuan | |
| 6,344,727 | B1 | 2/2002 | Desai et al. | |
| 6,354,713 | B1 | 3/2002 | Leifer et al. | |
| 6,356,084 | B1 * | 3/2002 | Levine | 324/556 |
| 6,358,089 | B1 | 3/2002 | Kuroda et al. | |
| 6,431,915 | B1 | 8/2002 | Ko | |
| 6,454,592 | B2 | 9/2002 | Takagi | |
| 6,461,173 | B1 | 10/2002 | Mizuno et al. | |
| 6,464,542 | B1 | 10/2002 | Lee | |
| 6,468,110 | B2 | 10/2002 | Fujino et al. | |
| 6,478,603 | B1 | 11/2002 | Wu | |
| 6,485,328 | B1 | 11/2002 | Wu | |
| 6,524,119 | B2 | 2/2003 | Kato et al. | |
| 6,577,877 | B1 | 6/2003 | Charlier et al. | |
| 6,585,540 | B2 * | 7/2003 | Gutierrez et al. | 439/620.19 |
| 6,591,085 | B1 | 7/2003 | Grady | |
| 6,607,397 | B1 | 8/2003 | Zhang et al. | |
| 6,608,264 | B1 | 8/2003 | Fouladpour | |
| 6,616,473 | B2 | 9/2003 | Kamata et al. | |
| 6,619,986 | B1 | 9/2003 | Yeh | |
| 6,653,813 | B2 | 11/2003 | Khatri | |
| 6,728,546 | B1 | 4/2004 | Peterson et al. | |
| 6,776,626 | B2 | 8/2004 | Huang et al. | |
| 6,776,665 | B2 | 8/2004 | Huang | |
| 6,813,528 | B1 | 11/2004 | Yang | |
| 6,816,376 | B2 | 11/2004 | Bright et al. | |
| 6,840,807 | B2 | 1/2005 | Ooya et al. | |
| 6,859,854 | B2 | 2/2005 | Kwong | |
| 6,991,483 | B1 | 1/2006 | Milan | |
| 2002/0010759 | A1 | 1/2002 | Hitson et al. | |
| 2002/0029303 | A1 | 3/2002 | Nguyen | |
| 2002/0065074 | A1 | 5/2002 | Cohn et al. | |
| 2002/0103008 | A1 | 8/2002 | Rahn et al. | |
| 2002/0115480 | A1 | 8/2002 | Haung | |
| 2002/0151327 | A1 | 10/2002 | Levitt | |
| 2002/0156546 | A1 | 10/2002 | Ramaswamy | |
| 2003/0008553 | A1 | 1/2003 | Oleynick et al. | |
| 2003/0028664 | A1 | 2/2003 | Tan et al. | |
| 2003/0067741 | A1 | 4/2003 | Alfonso et al. | |
| 2003/0073432 | A1 | 4/2003 | Meade | |
| 2004/0090998 | A1 | 5/2004 | Chen | |
| 2004/0186935 | A1 | 9/2004 | Bell et al. | |
| 2004/0224638 | A1 | 11/2004 | Fadell | |
| 2004/0235339 | A1 | 11/2004 | Sato et al. | |
| 2005/0014536 | A1 | 1/2005 | Grady | |
| 2005/0227537 | A1 | 10/2005 | Peng | |
| 2005/0239333 | A1 | 10/2005 | Watanabe et al. | |
| 2006/0160429 | A1 * | 7/2006 | Dawiedczyk et al. | 439/676 |
| 2006/0232385 | A1 * | 10/2006 | Scherer et al. | 340/286.02 |

FOREIGN PATENT DOCUMENTS

| | | | |
|---|---|---|---|
| EP | 0805523 | A2 | 11/1997 |
| JP | 7-176351 | A | 7/1995 |
| JP | 10-321302 | A | 12/1998 |
| JP | 10-334993 | A | 12/1998 |
| JP | 2000-223215 | A | 8/2000 |
| JP | 2000-223216 | A | 8/2000 |
| JP | 2000-223218 | A | 8/2000 |
| JP | 2001-35603 | A | 2/2001 |
| JP | 2001-196133 | A | 7/2001 |
| JP | 2001-230021 | A | 8/2001 |

OTHER PUBLICATIONS

Lewis, Peter; "On Technology"; 2002, *Fortune Magazine*, pp. 240.
"iPodDock/iPod Cradle"; www.bookendz/dock_cradle.htm, downloaded Feb. 27, 2003, 2 pages.
"Neuros MP3 Digital Audio Computer"; www.neurosaudio.com, downloaded Apr. 9, 2003, 6 pages.

* cited by examiner

| Pin | Signal Name | I/O | Function |
|---|---|---|---|
| 1 | DGND | GND | Digital ground in mobile device. |
| 2 | DGND | GND | Digital ground in mobile device. |
| 3 | TPA+ | I/O | FireWire signal |
| 4 | USB D+ | I/O | USB signal |
| 5 | TPA- | I/O | FireWire signal |
| 6 | USB D- | I/O | USB signal |
| 7 | TPB+ | I/O | FireWire signal |
| 8 | USB Vbus | I | USB power in: used to detect a USB host. |
| 9 | TPB- | I/O | FireWire signal |
| 10 | Accessory Identify | I | Identify external accessory |
| 11 | F/W PWR+ | I | FireWire and charger input power (8V to 15V DC) |
| 12 | F/W PWR+ | I | Firewire and charger input power (8V to 15 DC) |
| 13 | Accessory Power | O | 3.3V is the nominal output. Normal current in low power mode is 5 mA. with current limited to 100 mA in high power mode. |
| 14 | Reserved | | |
| 15 | DGND | GND | Digital ground in mobile device. |
| 16 | DGND | GND | Digital ground in mobile device. |
| 17 | Reserved | | |
| 18 | RX | I | Receive data |
| 19 | TX | O | Transmit data |
| 20 | Accessory Detect | I | Accessory Detect |
| 21 | S Video Y | O | Luminance component of S video. |
| 22 | S Video C | O | Chrominance component of S video. |
| 23 | Composite Video | O | Composite signal |
| 24 | Remote Sense | I | Detect remote |
| 25 | LINE-IN L | I | Line level input to the mobile device for the left channel. |
| 26 | LINE-IN R | I | Line level input to the mobile device for the right channel. |
| 27 | LINE-OUT L | O | Line level output to the mobile device for the left channel. |
| 28 | LINE-OUT R | O | Line level output to the mobile device for the right channel. |
| 29 | Audio Return | – | Audio return. This is a signal and should never be grounded inside the accessory. |
| 30 | DGND | GND | Digital ground in mobile device. |
| 31 | Chassis | | Chassis ground for connector shell. |
| 32 | Chassis | | Chassis ground for connector shell. |

FIG. 3

BACKWARD COMPATIBLE CONNECTOR SYSTEM

CROSS-REFERENCES TO RELATED APPLICATIONS

This application is related to U.S. Pat. No. 6,776,660, titled "Connector," and commonly-assigned patent application Ser. No. 10/833,689, titled "Connector Interface System for Multi-Communication Device," filed Apr. 27, 2004, now U.S. Pat. No. 7,441,062, and Ser. No. 10/423,490, titled "Media Player System," filed Apr. 25, 2003, all three of which are hereby incorporated by reference.

BACKGROUND OF THE INVENTION

The present invention relates in general to connectors for electronic systems. More particularly, the invention relates to various implementations of and methods of manufacture for connector systems that connect portable or handheld devices to other electronic devices.

The last half decade has witnessed a rapid proliferation of handheld consumer electronic devices such as mobile phones, digital media players, personal digital assistants and the like. The connector technology that enables electrical interconnection between these devices and other electronic systems such as host computers, accessories and power supplies, has evolved to meet the various requirements of these systems from electrical specifications and interface protocols to form factor. A good example of a highly versatile connector system can be found in the 30-pin connector platform various aspects of which are described in the above-referenced issued patent and pending patent applications. A vast array of electronic devices has been developed incorporating the 30-pin connector platform as the primary means for providing electrical interconnectivity. As the industry evolves, subsequent generations of devices for new and old applications rely on backward compatibility of the connector platform in order to interface and operate with existing devices. On the other hand, the ever present demand for reducing the size of electronic devices or otherwise modifying their structure for other industrial design considerations, particularly in the handheld consumer electronics market, often requires a redesign of many aspects of the device including the connectors. There is therefore a need for improved connector systems that meet the challenges presented by these competing demands.

BRIEF SUMMARY

Various embodiments of the present invention provide improved connector systems with more compact and monolithic design while maintaining backward compatibility. In one embodiment, alignment posts on the two sides of a plug connector are substantially removed and the remaining connector shell reshaped so as to preserve alignment capability. The reshaped connector includes, in one embodiment, a shell that is made of a single sheet of conductive material wrapped around the connector forming a single seam. Other pre-existing features such as alignment grooves and some or all springy raised tabs can be eliminated resulting in a more compact and monolithic structure for the connector without impacting functionality or backward compatibility. In another embodiment, a trim ring is molded to the base of the connector to form an integrated unit with the connector. The integrated unit can result in reduced size for the connector when it is incorporated into other devices such as a docking station. In yet another embodiment, a printed circuit board is integrated into the boot of a connector assembly to act as an intermediate connection mechanism between the cable wires and the connector pins. Other functionality such as identification circuitry or electrostatic discharge protection circuitry can be incorporated on to the integrated printed circuit board.

Accordingly, in one embodiment, the present invention provides a plug connector for use in a connector system having a receptacle connector, the receptacle connector having alignment projections projecting toward an interior of a box shaped housing of the receptacle connector, the plug connector including: a body having a bottom plate with a width W, a top plate with a width W' that is smaller than W, a first side plate and a second side plate each having a step to accommodate the width differential between the top and bottom plates, wherein the first and second side plates are smaller relative to the top and bottom plates providing a substantially flat body; and an array of electrodes extending in the direction of the depth of the body and being positionally secured by insulating material to an interior surface of the bottom plate of the body leaving an insertion cavity in the interior of the body between the array of electrodes and the top plate, wherein the steps in the first and second side plates are aligned with the alignment projections of the receptacle connector to guide insertion of the plug connector into the receptacle connector housing. The plug connector further includes a shell that is made of a single sheet of conductive material wrapped around the body.

In another embodiment, the plug connector further includes an integrated trim ring molded to a base of the plug connector. In a specific embodiment the integrated trim ring is made of glass reinforced nylon. In a further embodiment, the number of barbs that hold in place an electrode inside the plug connector is reduced.

In yet another embodiment, the invention integrates a printed circuit board inside the boot of a cable connector assembly. In this embodiment, wires from the cable electrically couple to the connector electrodes via the printed circuit board. In a specific embodiment the printed circuit board further includes additional functionality such as an identification circuit or an electrostatic discharge protection circuit.

These and other features of the modified connector yield a more compact and monolithic connector assembly that remains compatible with previously existing mating connectors. The following detailed description and the accompanying drawings provide a better understanding of the nature and advantages of the connector system of the present invention.

BRIEF DESCRIPTION OF THE DRAWINGS

FIG. 3 is a table identifying an example of pin designations for the connector;

DETAILED DESCRIPTION

Figure 1:
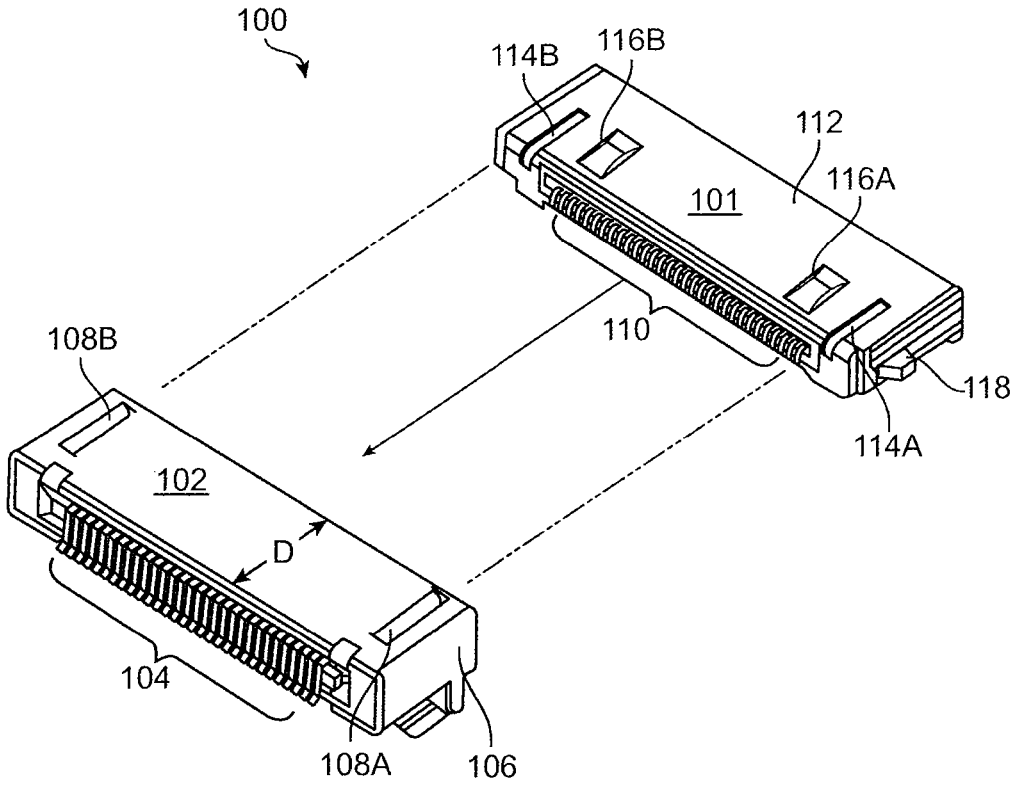
FIG. 1 illustrates isometric views of a plug connector and a receptacle connector and the manner of connecting the connectors.

Referring to FIG. 1, there is shown a connector system 100 that is currently in use by a vast array of electronic devices including handheld media players such as the iPod™ and a host of accessories developed for such handheld media players. Connector system 100 includes a plug connector 101 that is insertable into a receptacle connector 102. The connectors are designed such that when in mating position, an array of pins 110 housed in plug connector 101 are in contact with a corresponding array of pins 104 housed in receptacle connector 102. To properly align the two arrays of pins during the insertion process, receptacle connector 102 includes a pair of projections 108A and 108B that project from its outer shell inwardly. In one embodiment, projections 108A and 108B are formed by cutting the top plate of the connector shell in an angled C (or bracket) shape and bending the resulting tongue pieces toward the interior of the plug housing. Plug connector 101 in turn includes a corresponding pair of grooves or slits 114A and 114B that when brought into contact with receptacle connector 102, engage projections 108A and 108B and help guide the insertion process.

In some embodiments, plug connector 101 includes a shell or chassis with a top plate and a bottom plate made of conductive material to reduce electromagnetic interference (EMI) when the connectors carry electrical signals. Plug connector 101 further includes raised springy tabs 116A and 116B that increase compressive action between the two mating connectors for more secure engagement and to further improve EMI containment. In other embodiments, plug connector 101 also includes a latching mechanism such as springy retention pins 118 on either side of the plug connector body. When inserted into receptacle connector 102, retention pins 118 are first pushed in and then released once inside the body of the receptacle connector to latch the two connectors.

Figure 2A:
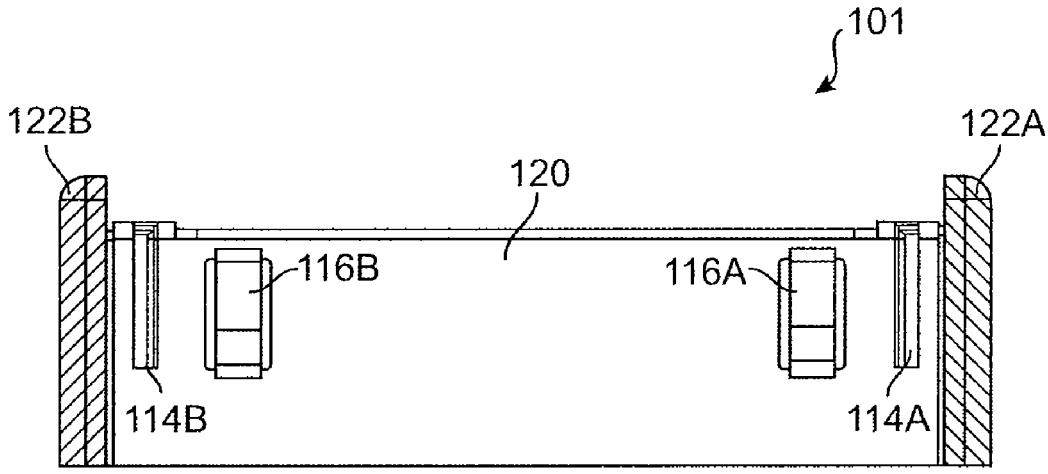
FIGS. 2A and 2B illustrate simplified top view and cross-sectional view, respectively, of an existing plug connector.
Figure 2B:
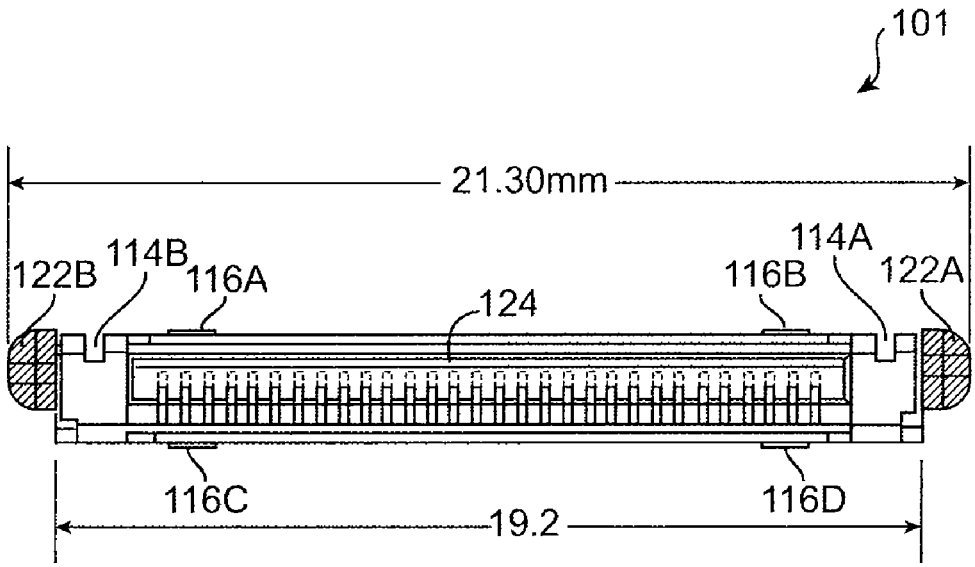

FIGS. 2A and 2B provide exemplary top and cross-sectional views, respectively, of plug connector 101. In the embodiment depicted, plug connector 101 includes alignment posts 122A and 122B on sides of the connector housing. In this embodiment, top plate 120 as well as tabs 116A and 116B are made of conductive material such as metal while alignment posts 122A and 122B are made of non-conductive material such as plastic resin. The frontal cross-sectional view of plug connector 101 in FIG. 2B shows array of pins 110 that are affixed to the inside wall of the lower plate of the connector housing in a bed of dielectric material, leaving a cavity 124 in the remaining portion of the connector interior. In one embodiment the bed of dielectric material can accommodate 30 pins. An exemplary pin designation for the 30 pins plus two chassis ground tabs or pins as used in the iPod™ media player is shown in FIG. 3. While the dielectric bed may accommodate 30 pins, the actual number of conductive pins included in the dielectric bed can vary depending on the application. Also, the number of chassis pins can be fewer or more than the two listed in FIG. 3. In one example, as many as six chassis pins provide the grounding for the connector shell as well as the mechanism to physically fasten the connector by soldering them to a board. FIG. 2B also shows a pair of springy raised tabs 116 on each side of the connector housing. This particular connector 101 is about 21.30 mm wide when measured from the outer edges of alignment posts 118 and about 19.2 mm wide when excluding alignment posts 122. Other structural and electrical details of illustrative embodiments for the connector system 100 are provided in the above-referenced U.S. Pat. Nos. 6,776,660 and 7,441,062, and pending patent application Ser. No. 10/423,490, all three of which are incorporated herein by reference.

As mentioned above, connector system 100 has provided an interconnection platform that has been widely employed by a vast array of electronic devices. Connector system 100 interconnects handheld media players with other electronic devices including host computers and accessory devices such as dock stations, many different types of cable connectors, battery chargers and power adapters, Hi-Fi sound systems and RF systems, and camera connectors, among many other types of devices. As the consumer electronics industry evolves, changing industrial design considerations and the demand for further miniaturization require modifications to the structure and design of the connectors. The challenge is therefore to meet the evolving industrial design requirements while maintaining compatibility with existing devices. In one embodiment, the present invention modifies the structural design of plug connector 100 to achieve a more compact and monolithic structure without impacting functionality or compatibility with exiting receptacle connectors.

Figure 4:
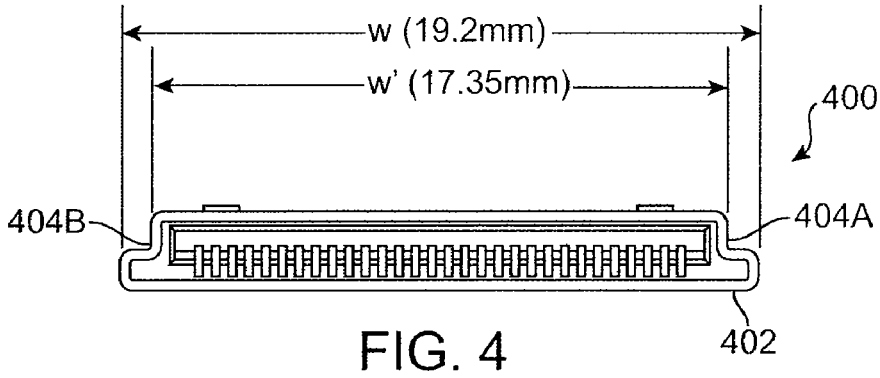
FIG. 4 provides a frontal cross-sectional view of a modified yet backward compatible plug connector according to one embodiment of the invention.

Referring to FIG. 4, there is shown a connector 400 according to one embodiment of the present invention. Connector 400 is more compact compared to plug connector 101 yet it is functionally equivalent and structurally compatible with connector system 100. A number of structural modifications have allowed connector 400 to be more compact yet backward compatible. Among these are the elimination of alignment posts 118. This has resulted in two advantageous features. First, the total width W of the connector has been reduced from about 21.30 mm to about 19.2 mm. Second, the elimination of the alignment posts allows for the option of building the connector shell 402 from a single sheet that wraps around the entire connector housing. In one embodiment, the single sheet forming the connector shell is made of conductive material such as metal further improving the connector's EMI containment.

Second, instead of grooves or slits (114 in FIGS. 1 and 2), a step 404 has been formed at each of the side plates of shell 402 as shown in FIG. 4. This results in an upper plate (as depicted in FIG. 4) having a width W' of about 17.35 mm which is smaller than the width W of the lower plate which is about 19.2 mm. The dimensions of the plates and those of the resulting steps 404A and 404B are designed to frictionally fit engagement projections 108 of receptacle connector 102 when connector 400 is inserted into receptacle connector 102. The angles and radius of curvature for steps 404 are designed to facilitate manufacturability of shell 402 as a single sheet of conductive material. In the example shown, each of the three edges resulting from the step on each side has a curved contour as opposed to sharp angles.

Figure 5A:
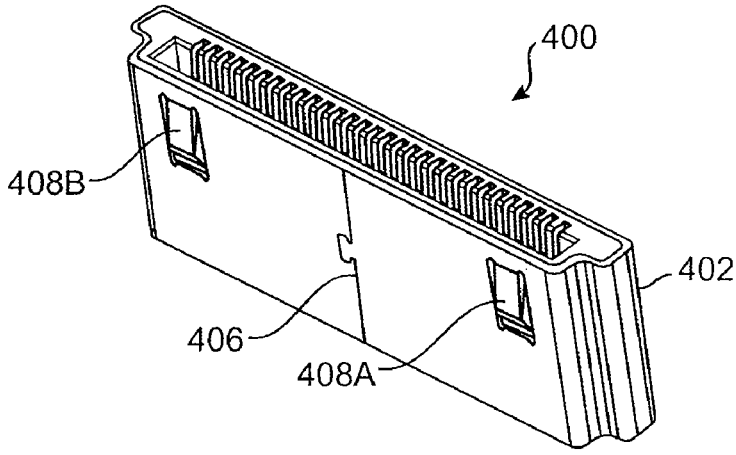
FIGS. 5A and 5B show isometric views of the front and back of a modified yet backward compatible plug connector according to one embodiment of the invention.
Figure 5B:
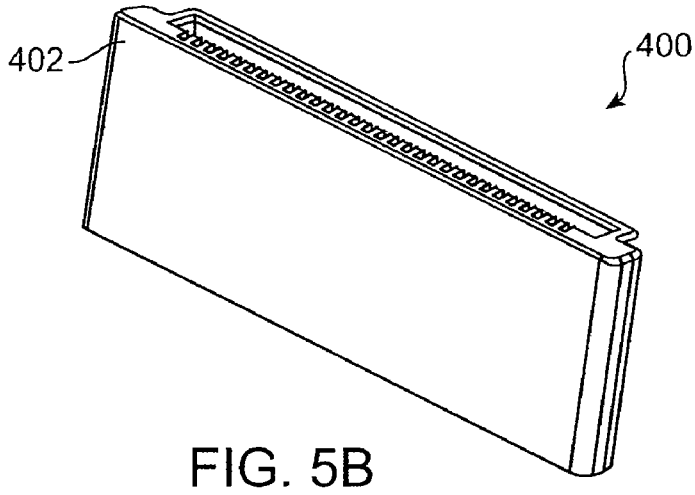

FIGS. 5A and 5B show isometric views of the front and back of connector 400 according to this embodiment of the invention. As shown in FIGS. 5A and 5B, shell 402 is made of a single sheet of material that wraps around the connector coming to a seam 406. In this embodiment, connector 400 includes springy tabs 408A and 408B on one plate and not the other of shell 402 of the connector. It is to be understood that the provision of tabs 408 can vary from two or more on each side to none at all. The combination of these modifications yields a connector structure that is more compact and monolithic yet is still compatible with previously existing connector system 100.

Figure 6:
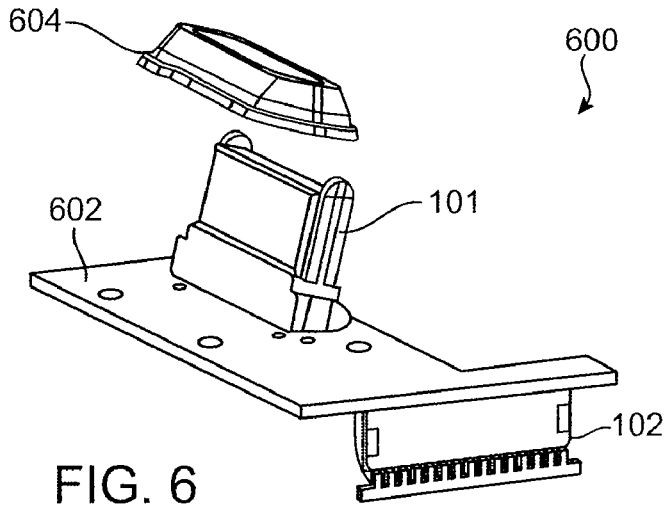
FIG. 6 provides a perspective view of a subset of components of an existing docking system.
Figure 7A:
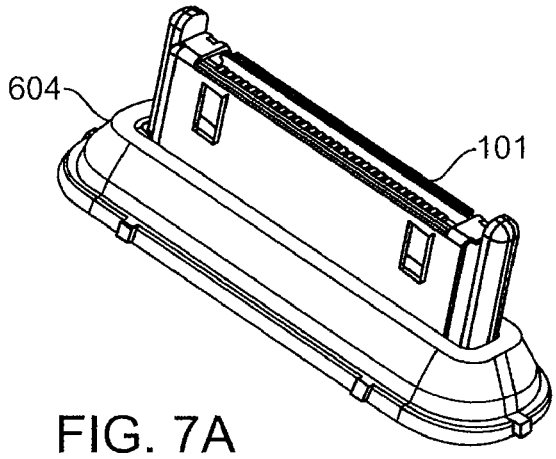
FIGS. 7A and 7B show a connector with a protective ring placed over its base and a side view of the same as placed on a printed circuit board, respectively.
Figure 7B:
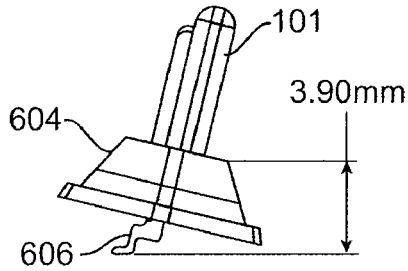

As explained above, the plug connector has numerous applications from cables to dock stations. According to another embodiment of the invention, further miniaturization of the connector assembly is achieved when connector 400 is part of a dock station. FIG. 6 provides a perspective view of a subset of components of a docking system 600. A connector such as plug connector 101 (FIG. 1) is mounted on a top surface of printed circuit board (PCB) 602 while a receptacle connector such as receptacle connector 102 (FIG. 1) is attached to the side of PCB 602. Before fully assembling docking system 600, a protective ring 604 that is typically made of plastic, is inserted around the base of connector 101. FIG. 7A illustrates an isometric view of the combined connector 101 and plastic trim ring 604, while FIG. 7B provides a side view of the same. As shown both in FIG. 6 and FIG. 7B, the connector/ring assembly is typically tilted at an angle, in this example, of about 15 degrees from the vertical axis. This angle results in the device that is being docked in system 600 to be tilted to provide a better viewing angle to the user. Also noted in FIG. 7B is the total thickness of the resulting base structure of the assembly which in this case is about 3.9 mm. FIG. 7B also shows pin 606 that extends out from under the base and onto the PCB.

Figure 8A:
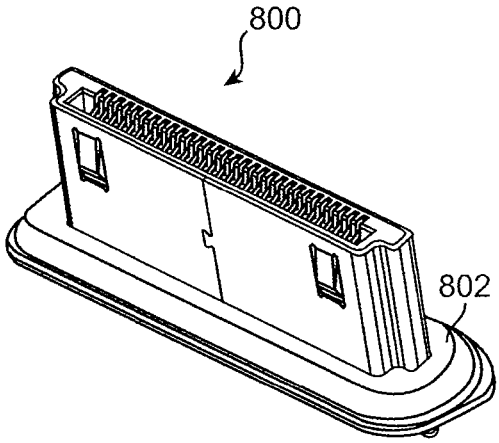
FIGS. 8A and 8B provide isometric views of the back and the front, respectively, of an integrated connector plus protective ring according to an embodiment of the present invention.
Figure 8B:
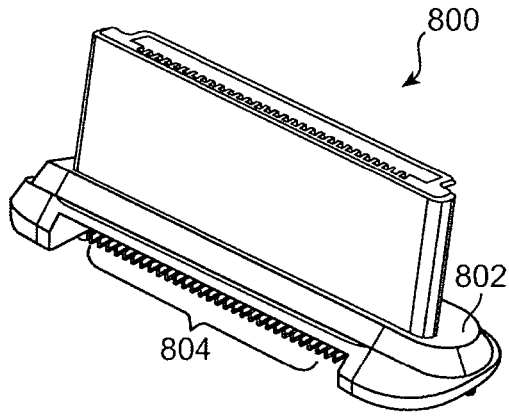

According to one embodiment of the invention, instead of using a separate plastic trim ring that is inserted around the base of the connector, a smaller trim ring is molded to the connector base to form an integrated unit. FIGS. 8A and 8B show isometric views of the back and front of a connector assembly 800 with an integrated trim ring 802. FIG. 8B illustrates the opening in trim ring 802 through which pins 804 can be accessed. The soldering process that electrically connects pins 804 to conductive traces on the PCB exposes connector assembly 800 to high temperatures. Trim ring 802 is therefore preferably made of material that can withstand higher temperatures, such as glass reinforced nylon and the like.

Figure 9A:
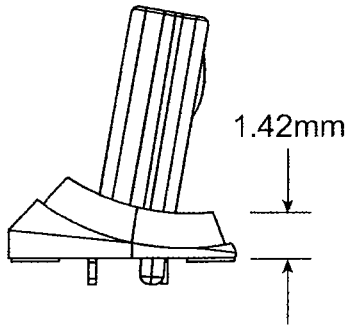
FIGS. 9A and 9B illustrate side views of an integrated connector plus protective ring and the shape of a modified pin, respectively, according to another embodiment of the present invention.

Connector assembly 800 with integrated trim ring 802 has appreciably reduced thickness and can therefore sit lower in the dock base. FIG. 9A notes the reduction in the base thickness for an illustrative embodiment wherein the thickness of the base is reduced to about 1.42 mm. While FIGS. 8A and 8B show the use of the more compact connector design (400 in FIGS. 4 and 5) as part of connector assembly 800, previously existing connectors can also benefit from the molded trim ring design. It should be noted that in some applications it may be desirable to have a gap between the bottom of the device being docked and the dock surface around the connector. For example, a handheld electronic device may have an integrated sound system, such as a microphone and speakers, with openings that are located at the base of the device in proximity to the connector that mates with the dock connector. The acoustic requirements of such a device may dictate that there be a gap between the bottom of the device and the dock surface when the device is docked. For such applications, the overall height of connector assembly 800 may be adjusted to create the desired gap to improve acoustic performance of the device.

Figure 9B:
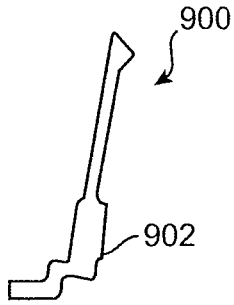

In another embodiment, connector assembly 800 uses pins (804 in FIG. 8B) that are smaller in size. FIG. 9B shows the shape of an exemplary pin 900. Pin 900 is both shorter in height and has fewer barbs, in this example one barb, 902. The pins used in existing connectors such as plug connector 101 (FIG. 1) are typically designed with multiple barbs and are taller. The barbs are generally added to the pin structure to add to the retention force when they are housed inside the connector. The reduced size of the overall connector structure allows connector assembly 800 to employ pins 900 that are shorter and have fewer barbs. In one embodiment, connector assembly 800 is designed to sit on the PCB of the docking system at a reduced angle as compared to that shown in FIG. 7B. According to this embodiment, the angle of connector assembly is reduced to about 10 degrees from the vertical axis. The reduced angle reduces the likelihood of tipping when a media player device is inserted into the dock station and therefore allows for a smaller footprint for the docking station. Exemplary docking systems wherein connector assembly 800 and its various features can be employed are described in greater detail in commonly-assigned patent application Ser. No. 11/212,302, titled "Docking Station for Handheld Electronic Devices," filed on Aug. 24, 2005, as well as patent application Ser. No. 10/423,490, titled "Media Player System," filed Apr. 25, 2003, both of which are hereby incorporated by reference in their entirety.

Figure 10A:
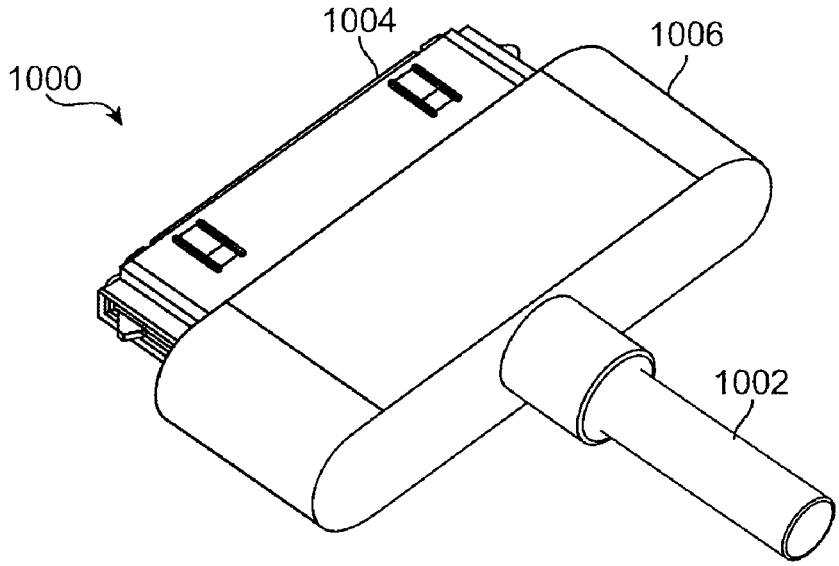
FIGS. 10A and 10B show an embodiment of a connector assembly with a printed circuit board integrated into the boot of the connector, and the fully assembled connector, respectively.

In yet another embodiment, the invention provides an improved cable connector assembly that integrates a PCB inside the connector boot. Referring to FIG. 10A, there is shown one end of a cable 1002 connecting to a cable connector assembly 1000. Cable connector assembly 1000 includes a connector 1004 that is attached to cable 1002 via a boot section 1006. Boot 1006 is typically made of material such as plastic and is provided to protect the wiring that electrically interconnects connector 1004 to wires inside cable 1002, and to provide a handle for the user. Instead of directly soldering the wires inside cable 1002 to the pins from connector 1004, the invention according to this embodiment, uses a PCB as an intermediary connection mechanism between the cable and the connector. The PCB is housed inside boot 1006 of cable connector assembly 1000. The connector 1004 as shown in FIG. 10A is of the type shown in FIGS. 1 and 2 (plug connector 101). It is to be understood that this embodiment of the invention works equally as well with the modified connector such as those described in connection with FIGS. 4 and 5.

Figure 10B:
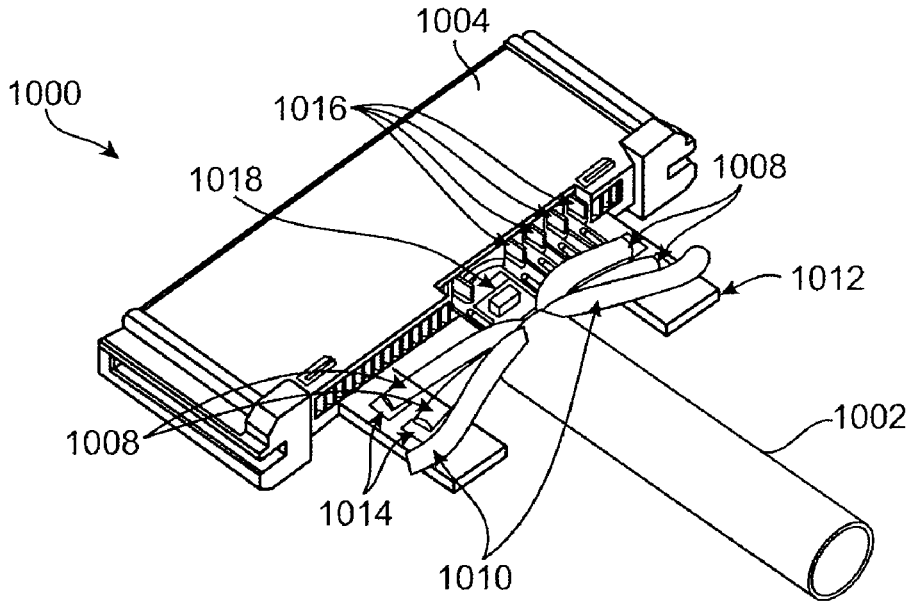

FIG. 10B illustrates the internal construction of cable connector assembly 1000 according to an illustrative embodiment of the present invention. Insulated wires 1008 extend outside cable 1002 near the point of contact between cable 1002 and connector 1004. It is to be understood that while in this example only four wires 1008 are shown, the number of wires can vary depending on the application for the cable connector. For example, when the other end of the cable connects to a universal serial bus (USB) connector the cable would carry four wires. In the embodiment shown in addition to the four wires 1008 cable 1002 also includes a braid 1010 that is split extending out from the cable end. Braids 1010 are preferably in the form of mesh braid and provide shielding for ground and other conductive components of the connector. The assembly further includes a PCB 1012 that is attached to connector 1004 by, for example, solder mechanism. PCB 1012 includes solder pads 1014 where wires 1008 land and make electrical connection thereto. Conductive traces on PCB 1012 (not shown) connect pads 1014 to appropriate pins in connector 1004 via contacts 1016. PCB 1012 as depicted in the example shown in FIG. 10B has the shape of an angled C (or a bracket), or if viewed along with cable 1002, it is in the shape of the hat of the letter T. Other shapes for PCB 1012 are possible.

Directly connecting cable wires to connector pins requires a higher degree of precision when multiple cable wires are connected to multiple closely spaced connector pins. An advantage of integrating PCB 1012 in boot 1006 of cable connector assembly 1000 is the intermediate connection made via PCB 1012 relaxes those requirements. Another advantage of the cable connector assembly according to this embodiment of the invention is that the inclusion of PCB 1012 allows the manufacturer to incorporate other functionality such as electrostatic discharge (ESD) protection circuitry, cable identification circuitry or EMI containment provisions onto the PCB.

In one embodiment, PCB 1012 further includes a cable identification circuit that allows the device to which the cable is connected, to identify the type of cable. According to this embodiment, PCB 1012 includes a resistive element 1018 that is connected between two predetermined pins of connector 1004. In one example, resistor 1018 is connected between pins 10 and 15 of connector 1004, where pin 10 is an "Accessory Identify" input pin and pin 15 is a digital ground pin, according to the pin assignment table shown in FIG. 3. When cable connector assembly 1000 is inserted into an electronic device such as a portable media player or a mobile telephone, the device will be able to identify the type of cable by detecting the presence or absence of resistor 1018. As mentioned above, other functionality can be incorporated on to the integrated PCB depending on the application requirements. For example, cable 1002 itself may be wrapped in Ferrite which increases EMI absorption and further improves the cable RF performance. This aspect of the connector cable assembly is described in greater detail in co-pending and commonly-assigned patent application Ser. No. 11/649,656, titled "Cable with Noise Suppression," filed Jan. 3, 2007, now U.S. Pat. No. 7,342,172, which is incorporated herein by reference in its entirety.

Various embodiments for improved connectors and connector assemblies according to the present invention have been described. While these inventions have been described in the context of the above specific embodiments, many modifications and variations are possible. The above description is therefore for illustrative purposes and is not intended to be limiting. For example, references to various types of materials such as metal or glass reinforced nylon and the like are for illustrative purpose and other similar alternatives fall within the scope of the present invention. Also, references to top or bottom, or front and back of the various structures described above are relative and are used interchangeably depending on the point of reference. Similarly, dimensions and sizes provided throughout the above description are for illustrative purposes only and the inventive concepts described herein can be applied to structures with different dimensions. Accordingly, the scope and breadth of the present invention should not be limited by the specific embodiments described above and should instead be determined by the following claims and their full extend of equivalents.

What is claimed is:

1. A plug connector for use in a connector system having a receptacle connector, the receptacle connector having alignment projections projecting toward an interior of a box shaped housing of the receptacle connector, the plug connector comprising:

a body having a bottom plate with a width W, a top plate with a width W' that is smaller than W, a first side plate and a second side plate each having a step to accommodate the width differential between the top and bottom plates, wherein the first and second side plates are smaller relative to the top and bottom plate providing a substantially flat body; and an array of electrodes extending in the direction of the depth of the body and being positionally secured by insulating material to an interior surface of the bottom plate of the body leaving an insertion cavity in the interior of the body between the array of electrodes and the top plate, wherein the steps in the first and second side plates are aligned with the alignment projections of the receptacle connector to guide insertion of the plug connector into the receptacle connector housing.

2. The plug connector of claim 1 further comprising a shell that is made of a single sheet of conductive material wrapped around the plug connector.

3. The plug connector of claim 1 wherein the steps on each side plate of the plug connector have curved edges.

4. The plug connector of claim 1 wherein the array of electrodes can have up to 30 pins.

5. The plug connector of claim 1 further comprising an integrated trim ring molded to a base of the plug connector.

6. The plug connector of claim 5 wherein the trim ring is made of high temperature resilient material such as glass reinforced nylon.

7. The plug connector of claim 5 wherein the plug connector with the integrated trim ring is disposed on a printed circuit board at a predetermined angle from the vertical axis.

8. The plug connector of claim 7 wherein the predetermined angle is approximately 10 degrees from the vertical axis.

9. A cable connector assembly including the plug connector of claim 1, further comprising:

a cable housing a plurality of wires;

a boot connecting a first end of the cable to the plug connector, wherein electrical coupling between the plurality of wires inside the cable and the array of electrodes inside the plug connector is made via a printed circuit board integrated into the boot; and a resistor disposed on the printed circuit board and electrically coupled to a predetermined electrode of the plug connector.

10. The cable connector assembly of claim 9 wherein the printed circuit board comprises a plurality of solder pads adapted to receive a corresponding plurality of wires from the cable.

11. The cable connector assembly of claim 10 wherein the printed circuit board further comprises a plurality of conductive traces electrically coupling the plurality of solder pads to a corresponding plurality of contacts for the array of electrodes.

12. The cable connector assembly of claim 9 further comprising one or more electronic components placed on the printed circuit board and configured to perform one or more predetermined functions.

13. The cable connector assembly of claim 9 wherein the resistor disposed on the printed circuit board identifies a type of the cable connector.

14. The cable connector assembly of claim 12 wherein electrostatic discharge protection circuitry is disposed on the printed circuit board and is electrically coupled to one or more predetermined electrodes of the plug connector.

15. The cable connector assembly of claim 9 wherein the second end of the cable is coupled to a universal serial bus connector.

16. The cable connector assembly of claim 13 wherein the resistor is coupled between two predetermined electrodes.

17. The cable connector assembly of claim 16 wherein the array of electrodes comprises at least 30 pins disposed in a row and wherein the resistor is coupled between electrode number 15 and a ground electrode.

18. The cable connector assembly of claim 9 wherein the plurality of wires comprises four wires for universal serial bus (USB) connection.

19. The cable connector assembly of claim 9 wherein the cable comprises one or more mesh braids configured to provide electrical shielding.

20. The cable connector assembly of claim 9 wherein the printed circuit board is in the shape of a bracket with its opening adapted to receive the cable.

21. The cable connector assembly of claim 12 wherein EMI containment means are disposed on the printed circuit board.

22. The cable connector assembly of claim 9 wherein the cable comprises a Ferrite wrap adapted to increase EMI absorption.

* * * * *